United States Patent [19]

Clary et al.

[11] Patent Number: 4,846,281

[45] Date of Patent: Jul. 11, 1989

[54] DUAL FLAPPER VALVE ASSEMBLY

[75] Inventors: Sammy R. Clary, Jay, Fla.; Frank Giusti, Jr., Lewisville, Tex.; Richard M. Sproul, Grapevine, Tex.

[73] Assignee: Otis Engineering Corporation, Carrollton, Tex.

[21] Appl. No.: 222,149

[22] Filed: Jul. 21, 1988

Related U.S. Application Data

[63] Continuation-in-part of Ser. No. 89,979, Aug. 27, 1987, Pat. No. 4,813,481.

[51] Int. Cl.[4] ..... E21B 34/14; E21B 43/04

[52] U.S. Cl. ..... 166/373; 166/51; 166/317; 166/323; 166/386; 137/613; 137/614.02

[58] Field of Search ..... 166/278, 373, 376, 386, 166/387, 51, 205, 316–318, 323; 137/613, 614.2

[56] References Cited

U.S. PATENT DOCUMENTS

| | | | |
|---|---|---|---|
| 2,751,021 | 6/1956 | Muse | 166/225 |
| 3,032,050 | 5/1962 | Clark | 137/68 |
| 3,463,189 | 8/1969 | Fitzpatrick | 137/614.2 |
| 4,020,869 | 5/1977 | Davis et al. | 137/613 |
| 4,378,842 | 4/1983 | Patel | 166/317 X |
| 4,378,847 | 4/1983 | Patel et al. | 166/317 |
| 4,457,376 | 7/1984 | Carmody et al. | 166/332 |
| 4,474,241 | 10/1984 | Freeman | 166/317 |
| 4,540,051 | 9/1985 | Schmuck et al. | 166/278 |
| 4,541,484 | 9/1985 | Salerni et al. | 166/317 |
| 4,541,486 | 9/1985 | Wetzel et al. | 166/51 |
| 4,605,070 | 8/1986 | Morris | 166/380 |
| 4,691,775 | 9/1987 | Lustig et al. | 166/317 |

*Primary Examiner*—Bruce M. Kisliuk

*Attorney, Agent, or Firm*—Dennis T. Griggs

[57] ABSTRACT

A dual flapper valve assembly permits a well logging operation to be carried out after a gravel pack has been deposited without losing a large amount of completion fluid into the formation. The dual flapper valves can be closed and fractured independently of each other and selectively to accommodate a gravel pack operation, a well logging operation and a completion fluid recovery operation. The closure plate of the lower flapper valve is propped open by the wash pipe during the gravel pack operation. The lower closure plate is fractured to accommodate a well logging operation, while the closure plate of the upper flapper valve is held open by a prop sleeve. Upon completion of the well logging operation, the prop sleeve is retracted out of engagement with the closure plate of the upper flapper valve, thereby permitting the upper flapper valve to close. The heavy completion fluid remaining in the casing annulus is thereby conserved and can be recovered to the surface, while the gravel pack and the formation are protected from the pressure of the heavy completion fluid. After recovery of the completion fluid, the closure plate of the upper flapper valve is fractured to accommodate production operations.

10 Claims, 7 Drawing Sheets

DUAL FLAPPER VALVE ASSEMBLY

CROSS REFERENCE TO RELATED APPLICATION

This application is a continuation-in-part of U.S. application Ser. No. 07/089,979 filed Aug. 27, 1987 now U.S. Pat. No. 4,813,481.

FIELD OF THE INVENTION

This invention relates generally to well service equipment, and in particular to a formation protection valve assembly for limiting the loss of completion fluid after a gravel packing or other service operation has been completed.

BACKGROUND OF THE INVENTION

In a gravel pack operation, a service seal unit mounted on a work string is reciprocated relative to certain flow ports and sealing surfaces within a packer bore to route service fluid along various passages. The service seal unit carries vertical and lateral circulation passages which, when aligned with ports formed in a packer, permit service fluid such as acids, polymers, cements, sand or gravel laden liquids to be injected into a formation through the bore of the work string and into the outer annulus between a sand screen and a perforated well casing. The annular gravel pack prevents plugging and reduces damage to the screen caused by penetration of formation sand.

In one position of the service seal unit, the annulus below the packer is sealed and the lateral flow passages of the service seal unit are positioned for discharge directly into the annulus between the work string and the well casing, thereby permitting reverse flow and out circulation of clean-out fluids upwardly through the bore of the work string. After the gravel packing or other treatment is finished, completion fluids are introduced into the annulus to displace the service fluids used during well treatment. The service seal unit and the associated wash tube are then removed from the well.

Because of its high value, it is desirable to recover the completion fluid for use during subsequent operations. Additionally, it is desirable to control the effect of completion fluid pressure on the producing formation.

DESCRIPTION OF THE PRIOR ART

One method for controlling the effect of completion fluid pressure on the producing formation during a gravel pack operation is to spot a gel material in the bore through the liner as the wash pipe is withdrawn to close the liner to fluid flow and protect the formation from the pressure of completion fluid while the handling string is being pulled from the well and the production string is thereafter inserted.

Another method for protecting the gravel pack and adjoining production formation from penetration by completion fluids and the like is with an automatically operating flapper valve. Conventional flapper valves are mounted on a screen support sub between the screen and the packer for pivotal movement from an upright, open bore position, to a horizontal, closed bore position. The flapper valve is propped open in the upright, open bore position between the wash pipe and the inner bore of the screen support sub during run-in and gravel packing operations. Some flapper valves are biased by a spring so that upon removal of the gravel packing apparatus from the well, the flapper valve is moved into sealing engagement against a valve seat.

With the producing formation being protected by the closed flapper valve, the desired completion and clean-out operations may be carried out with the wash pipe disengaged and retracted. The handling string is then retrieved from the well and a production tubing string is run into the well in its place. The completion and clean-up operations may take several days, during which time the formation and the gravel pack are protected by the closed flapper valve.

It is sometimes desirable to perform an electric line logging operation prior to production to eetermine downhole well conditions in the region of the gravel pack. An electric line tool run is typically accomplished in a few hours, and the logging operation may take as many as ten to twelve hours. The electric line logging operation is performed after the gravel pack has been deposited, and after completion fluids have been introduced into the annulus to displace the service fluids used during well treatment, so that accurate, post-completion well conditions can be recorded and evaluated.

The service tool must be withdrawn from the packer before an electric line logging operation can be initiated. Upon withdrawal of the service tool and wash pipe, the flapper valve will close automatically, thus preventing the escape of the completion fluid into the formation. However, the flapper valve closure member must be forcibly opened before an electric line logging operation can be performed. Conventional flapper valves have a frangible closure member which can be ruptured, for example by the application of hydraulic pressure or in response to an impact force delivered by a drop bar.

The loss of completion fluid during the limited time required for an electric line logging operation may be tolerated, depending upon formation conditions. Post-completion well condition measurements should be made and data evaluated before the decision to begin production is made. In those instances, completion fluid may be sacrificed to obtain such post-completion well condition measurements.

It will be appreciated that, once the frangible flapper valve closure member has been ruptured, the gravel pack in the formation is exposed to the high pressure developed by the column of heavy completion fluid. Accordingly, it is desirable to complete the logging operation and retract the electric line logging equipment from the well quickly, rcover as much as of the heavy completion fluid as possible, and thereby minimize loss of the completion fluid and damage to the surrounding formation.

OBJECTS OF THE INVENTION

A general object of the present invention is to provide an improved formation protection valve assembly for limiting the loss of completion fluid into a formation during successive well service operations.

A related object of the present invention is to provide an improved formation protection valve assembly which will permit a well service operation such as an electrical log to be performed after a gravel pack has been deposited without losing a large amount of completion fluid into the formation.

Another object of the present invention is to provide an improved formation protection valve assembly having dual flapper valves which can be selectively closed and ruptured or fractured independently of each other to accommodate separate closed bore/open bore well service operations.

Another object of this invention is to provide a dual flapper valve assembly which is selectively operable to close and open a well bore to protect a production formation from the effects of fluid pressure within the well bore while accommodating well service operations.

Another object of this invention is to provide a method and apparatus for protecting a well during a gravel pack operation in which first and second flapper valves are utilized for controlling flow to the well screen, with both flapper valves being held open during gravel packing, with one flapper valve being closed upon withdrawal of the wash pipe from the screen and during clean-up operations, and being forcibly opened while the second flapper valve remains propped open to accommodate an additional well service operation such as an electrical log, with the second flapper valve being selectively closed upon completion of the subsequent service operation to isolate completion fluids in the well bore from the screen and production formation during round-tripping of the work string and the production string.

SUMMARY OF THE INVENTION

The foregoing objects are achieved according to the present invention by a dual flapper valve assembly which is mounted on a screen support sub which depends from a packer and located above the production zone of a well, with upper and lower flapper valves being connected in series flow relation between the screen and the packer. Each flapper valve assembly includes a valve seat having a flow passage bore and a frangible valve closure plate pivotally mounted on the valve seat for preventing flow through the flow passage bore when the closure plate is engaged against the valve seat.

The lower flapper valve has a frangible closure plate which is engagable by a gravel pack wash pipe and is propped open during the gravel pack operation when the wash pipe is extended through the packer. In the preferred embodiment, the upper flapper valve has a frangible closure plate which is propped open by a tubular prop sleeve which is mounted onto the screen support sub. The upper flapper valve closure plate is held open by the prop sleeve with the bore of the prop sleeve defining a flow passage for accommodating a gravel pack or other well service operation.

According to this arrangement, the lower flapper valve is closed upon partial retraction of the wash pipe after a gravel pack has been deposited. The closure plate of the lower flapper valve remains closed while the service fluids are displaced by heavy completion fluid. After the reverse-flow circulation-out operation has been performed, and the well annulus has been filled with completion fluid, the service tool and wash pipe are withdrawn from the well and a production seal unit is run into the well and installed in the packer. The frangible closure plate of the lower flapper valve is then ruptured by mechanical impact or hydraulic pressure to permit an electric line logging tool to be inserted into the screen flow region for measuring post-completion gravel pack conditions.

Upon completion of the logging operation, the logging tool is retracted from the well, and the prop sleeve is retracted out of engagement, thereby allowing the closure plate of the upper flapper valve to close. In one embodiment, the prop sleeve is connected to the screen support sub by shear pins, and is forcibly separated from the support sub in response to retraction of the wash pipe and engagement by a box shoulder carried on the wash pipe.

In an alternative embodiment, the prop sleeve is connected to a collet latch which is movable between an extended, blocking position in which the upper flapper valve is engaged and propped open by the prop sleeve, to a retracted, unblocked position in which the upper flapper valve closure member is released. In this alternative embodiment, the collet latch is initially set in the extended, valve open position and is retracted to the unblocked position by a wire line shifting tool.

In yet another alternative embodiment, the frangible closure plate of the lower flapper valve is propped open by a tubular prop sleeve which is mounted on a collet latch which is movable between an extended, blocking position in which the lower flapper valve is engaged and propped open by the prop sleeve, to a retracted, unblocked position in which the flapper valve closure plate is released. In this alternative embodiment, the frangible closure plate of the upper flapper valve is propped open by a tubular prop sleeve which is connected to the screen support sub by shear pins, and is forcibly separated from the support sub in response to retraction of the wash pipe and engagement by a box shoulder carried on the wash pipe.

According to the foregoing arrangement, the completion fluid is conserved, and the producing formation is protected from the pressure of the column of heavy completion fluid during retrieval of the work string and installation of the production string. Only a limited amount of completion fluid is permitted to escape during the logging operation. After the remaining completion fluid has been pumped to the surface, the closure plate of the upper flapper valve is fractured to clear the flow passage to the screen so that production operations can begin.

Other objects and advantages of the present invention will be appreciated by those skilled in the art upon reading the detailed description which follows with reference to the attached drawings.

DETAILED DESCRIPTION OF THE PREFERRED EMBODIMENT

Figure 1:
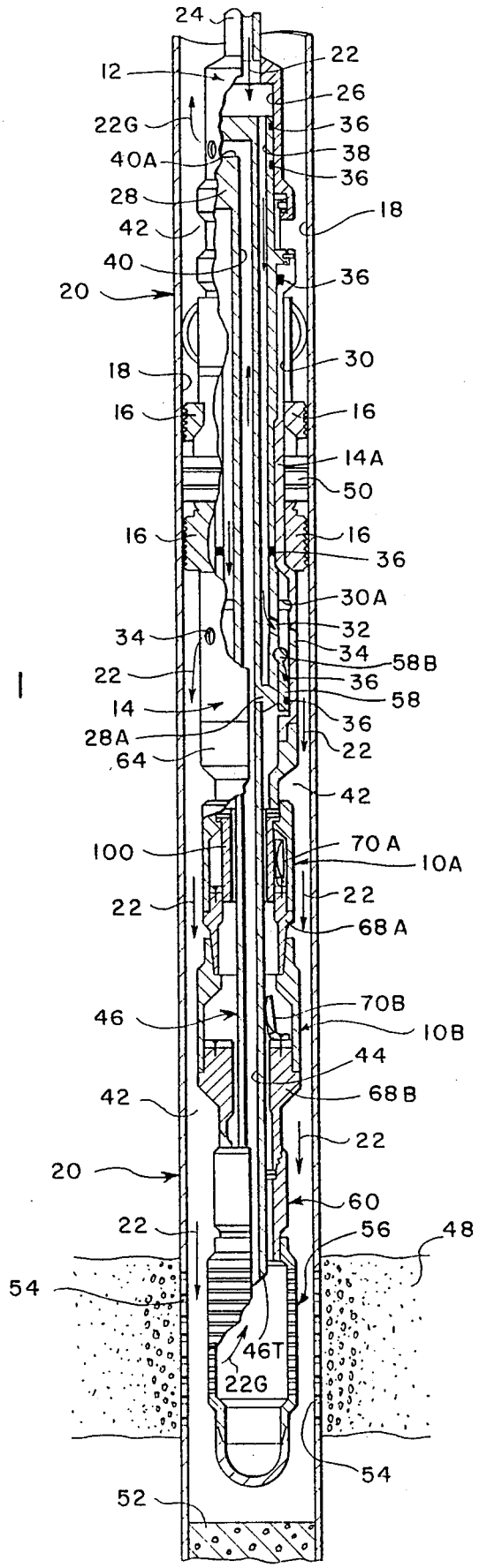
FIG. 1 is a view, partly in section and partly in elevation, showing a typical well installation using a dual flapper valve assembly constructed according to the present invention.

In the description that follows, like parts are marked throughout the specification and drawings with the same reference numerals, respectively. The drawings are not necessarily to scale and the proportions of certain parts have been exaggerated to better illustrate details of the present invention.

Referring now to FIG. 1, upper and lower flapper valve assemblies 10A, 10B constructed according to the teachings of the present invention are shown in valve open position for accommodating a gravel pack service operation. In this arrangement, a cross-over tool (service seal unit) 12 is landed within the bore 30 of packer 14. The packer 14 has hydraulically-actuated slips 16 which set the packer mandrel 14A against the bore 18 of a tubular well casing 20. The cross-over tool 12 is coupled to the packer while gravel slurry 22 is pumped through a work string 24 into the cross-over housing bore 26 of the cross-over tool.

The cross-over tool 12 has an elongate tubular body 28 which is telescoped into the bore 30 of the packer and has lateral flow ports 32 near its lower end which, when the cross-over tool 12 is landed in the packer bore, are approximately on the same level with lateral flow ports 34 formed near the lower end of the packer 14. A pair of seal rings 36 mounted on the cross-over tool body 28 seal the annulus between the cross-over tool and the packer above and below the lateral flow ports 32, 34. A third seal 36 carried by the cross-over tool seals the packer bore 30 near the upper end thereof to prevent the settling of sand and debris between the service seal unit and the packer. The upper end of cross-over tool body 28 has an offset, longitudinal flow passage 38 which provides communication between the cross-over housing bore 26 and the lateral flow port 32. Additionally, the cross-over tool body 28 has return flow passage bore 40 and a lateral cross flow passage 40A which provide flow communication between the well bore annulus 42 and the bore 44 of wash pipe 46.

The gravel slurry 22 is introduced into the well at the surface and is pumped down the work string 24 into the cross-over housing bore 26 where it enters the offset vertical flow passage 38 within the body of the cross-over tool 12 and is discharged laterally outwardly through the flow port 32 through the lateral openings 34 of the packer into the well annulus 42 below the packer. The annulus 42 between the casing 20 and the packer 12 is sealed above a producing formation 48 by expanded seal elements 50 carried on packer 14, and below the formation by a cement plug 52, or alternatively by corresponding seal elements carried on a lower packer (not shown) set below the formation. The annulus 42 below the packer 14 is filled with the slurry 22, and the slurry is pumped through perforations 54 formed in the well casing 20.

The slurry moves downwardly in the annulus 42 and surrounds a screen 56. As pressure is applied to the slurry, the slurry gel 22G flows through the screen where it enters the lower tail pipe end 46T of the wash pipe 46, and flows upwardly to the L-shaped passage 40 at the upper end of the cross-over tool 12 and is discharged into the upper well annulus 42 and moves upwardly to the surface as indicated by the arrow 22G. As the gravel is separated from the gel, the gravel settles in the well annulus and begins to collect in the bottom of the well and gradually accumulates around the screen 56.

The wash pipe 46 is threaded into the lower end 28A of the cross-over tool body 28 and extends downwardly through the tandem flapper valves 10A, 10B and through a screen connector nipple 60. The screen connector nipple 60 supports the screen 56 adjacent the casing perforations 54 with a tail pipe portion 46 of wash pipe 46 being suspended at location just above the screen 56.

A collet 58 carries a pair of axially spaced seals 36 into sealing engagement against the packer mandrel bore 30. As sham in FIG. 1, the collet 58 is fully extended, thereby opening lateral flow port 34 so that slurry 22 can be pumped through the longitudinal flow passage 38 of the cross-over tool 28, through the lateral flow port 32 and into the lower well annulus 42. However, when it is desired to close the lower flapper valve 70B and close lateral flow port 34 to perform a reverse circulate-out service operation, the cross-over tool 28 is retracted as shown in FIG. 2B, placing the seals 36 in a straddling position with respect to packer flow port 34 to prevent flow into the lower annulus 42 and thereby protecting the producing formation 48. The collet 58 has a double-sided boss 58B which is received on its radially inside portion within an annular locator groove formed on the cross-over tool 28. The radially outwardly projecting portion of the boss 58B is receivable in detented engagement with an upper annular locator groove 30A which is formed within the packer mandrel 30 upon retraction of the cross-over tool.

The upper flapper valve assembly 10A is suspended from the packer 14 by a support spacer sub 64. The upper and lower flapper valves 10A, 10B are assembled together by threaded pin and box connections in tandem series relation between the screen 56 and the packer 14. The lower flapper valve assembly 10B is mechanically attached to the screen 56 by the connector nipple 60.

After the gravel pack has been completed, the work string is retracted a predetermined distance which withdraws the tail pipe 46T out of the screen and permits the closure plate 70B of the lower flapper valve assembly 10B to move to the valve closed position as shown in FIG. 2B. In this retracted position, the L-shaped passage 40 is closed at the upper end of the service seal unit, and the cross-over tool 12 is retracted sufficiently to place the lower end of its body just above the upper end of the packer, so that clean-out fluids can be freely circulated from the surface downward through the well annulus, through the lateral openings 32 near the lower end of the crossover tool, and upwardly through the cross-over tool body and through the work string 24 to the surface. By circulating cleanout fluids in this manner, excess slurry is removed from the well, and the producing formation 48 is protected from the pressure of fluids in the upper annulus 42.

After the gravel packing or other treatment is finished, completion fluids are introduced into the upper annulus 42 to displace the service fluids used during well treatment. It is desirable to circulate the particulates and the completion fluid to the surface to prevent damage to the screen 56 and to avoid squeezing or otherwise disturbing the established position of the gravel pack. A commonly used completion fluid is aqueous calcium chloride, having a weight of approximately 11.5 pounds per gallon. It will be appreciated that a column of such completion fluid if unrestrained may penetrate the formation 48. The volume of the casing annulus 42 above the packer 14 may be as much as 8 to 10 times as great as the volume of the production tubing, so that a considerable amount of valuable completion fluid will be lost if permitted to penetrate into the surrounding formation, and the pressure of the column may have adverse effects upon the formation.

After the completion fluid has been introduced and reverse circulation completed, the cross-over tool 12 and the wash pipe 46 are removed from the well, leaving the packer 14, flapper valves 10A, 10B and screen 56 in the well, with the lower flapper valve 10B closed and the upper flapper valve 10A propped open.

Figure 2A:
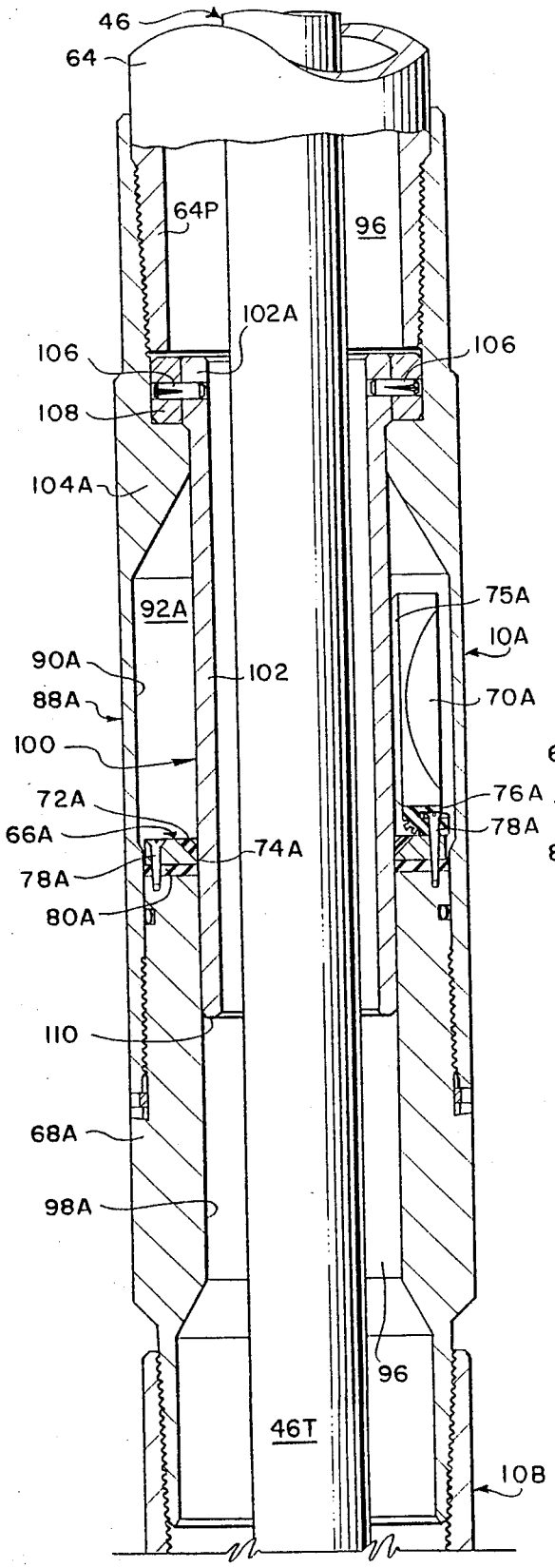
FIG. 2A is a sectional view of the upper flapper valve shown in FIG. 1, with its flapper valve closure member being held in valve open position by a prop sleeve and shear pin combination.
Figure 2B:
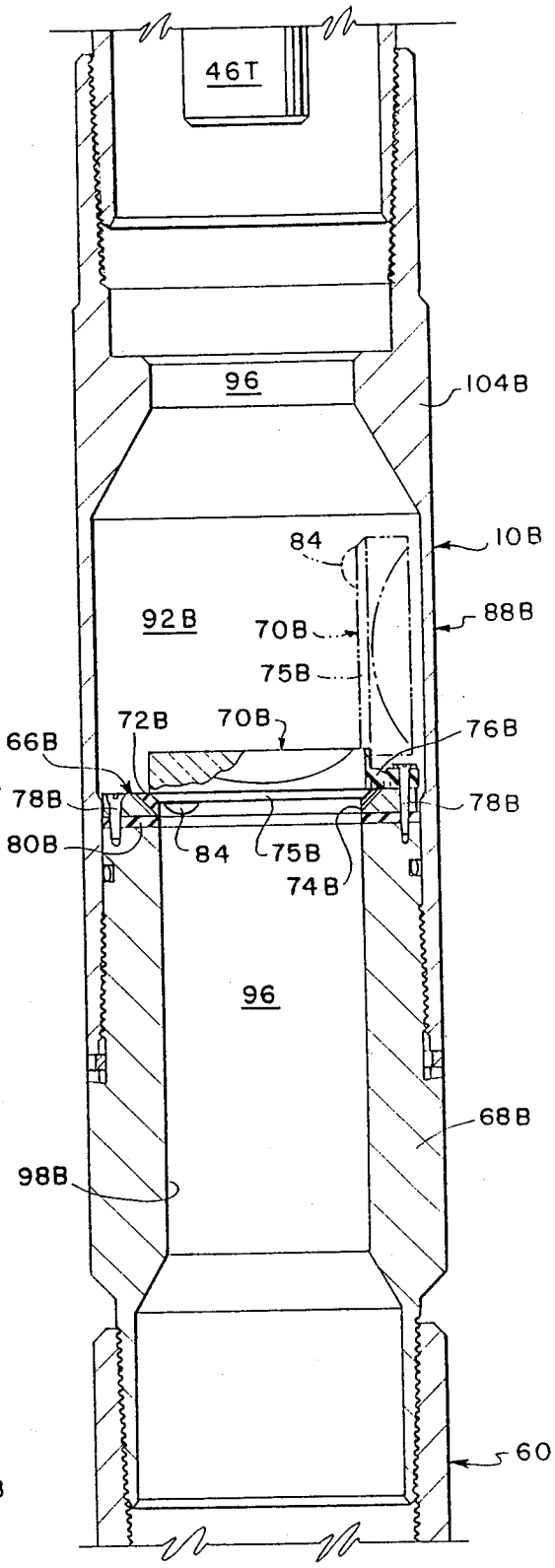
FIG. 2B is a view similar to FIG. 2A with the wash pipe retracted and the lower flapper valve in valve closed position.

Referring now to FIGS. 2A and 2B, the upper and lower flapper valve assemblies 10A, 10B in combination define a dual flapper valve assembly, with each flapper valve being selectively closed and capable of being fractured independently of the other to accommodate separate well service operations. Each flapper valve assembly includes a valve body 66A, 66B which is mounted on a connector sub 68A, 68B, respectively. Frangible valve closure plates 70A, 70B are pivotally mounted onto the respective valve bodies for sealing engagement against an annular, elastomeric valve seat 72A, 72B, respectively. Each annular valve seat is formed of a compressible elastomeric material and is concentric with the cylindrical bore 74A, 74B of the valve body. Each closure plate has an annular, beveled surface 75A, 75B for producing close sealing engagement against the elastomeric valve seat 72A, 72B, respectively.

Figure 3:
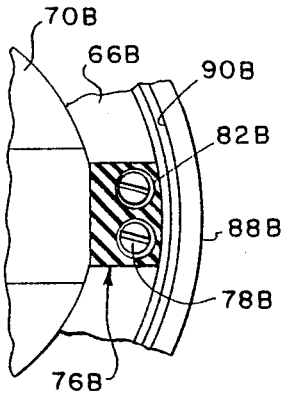
FIG. 3 is a top plan view, partly in section, of a flapper valve closure disk and elastomeric hinge combination.
Figure 4:
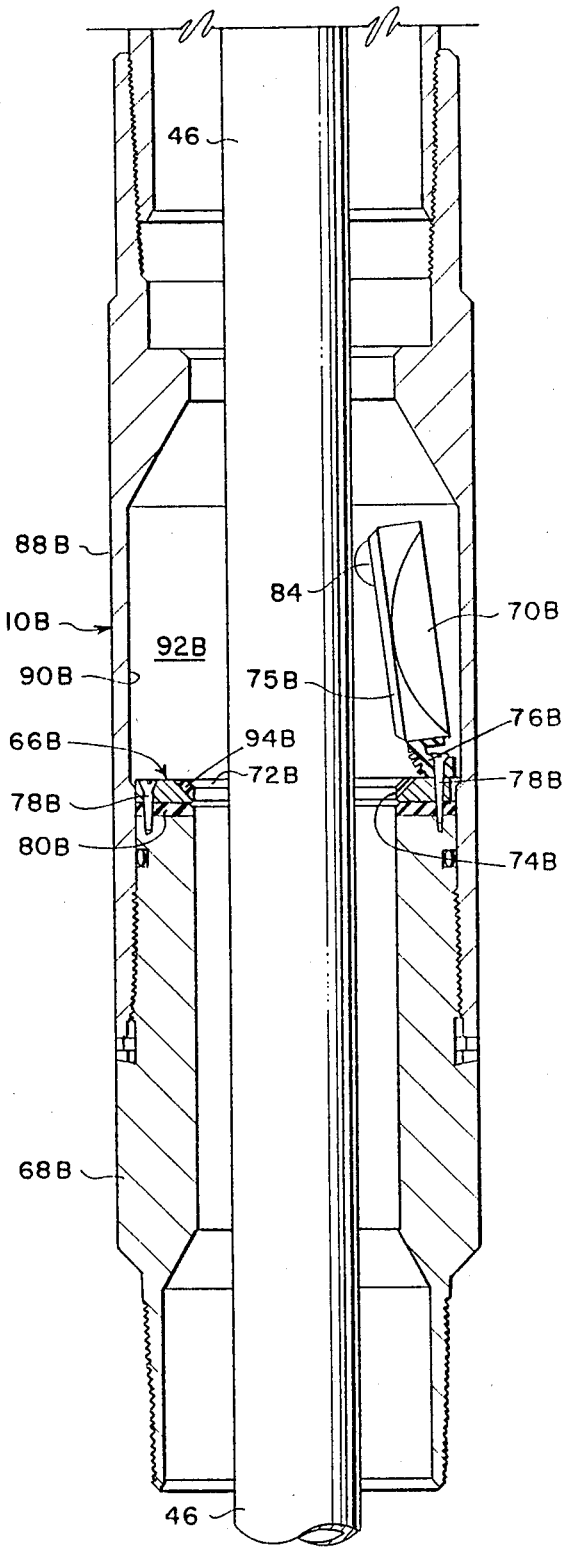
FIG. 4 is a sectional view, similar to FIG. 2B, with the lower flapper valve closure member being held in valve open position by a wash pipe.

Referring now to FIGS. 3 and 4, the valve closure plate 70B is pivotally mounted onto the valve body 72B by an elastomeric hinge 76B. The valve closure plate 70A is likewise pivotally mounted onto the valve seat 72A by an elastomeric hinge 76A.

Each valve body 66A, 66B is mounted onto the connector subs by screw fasteners 78A, 78B. Each valve body is sealed against a connector sub 68A, 68B by an annular elastomeric seal 80A, 80B, respectively. The elastomeric hinges 76A, 76B are anchored onto the valve body 72A, 72B by screw fasteners 78A, 78B, respectively. Each elastomeric hinge includes a tubular metal insert 82A, 82B for receiving the threaded fasteners 78A, 78B, respectively.

The frangible closure plate 72B of the lower flapper valve 10B has an elastomeric bumper 84 which engages the wash pipe 46 and is propped open, as shown in FIG. 4, during the gravel pack operation when the wash pipe is extended through the packer. According to this arrangement, the lower flapper valve 10B is closed automatically upon withdrawal of the wash pipe 46 as shown in FIG. 2B. The closure plate 70B of the lower flapper valve 10B remains closed against the valve seat 72B while the service fluids are displaced by heavy completion fluids. Thus, after the reverse-flow circulation-out operation has been performed, and the well annulus has been filled with heavy completion fluid, the service tool and wash pipe can be withdrawn without loss of the completion fluid.

During the course of the gravel pack operation, the lower flapper valve 10B is held in open valve position as shown in FIG. 1 and 4 by the wash pipe 46. Upon withdrawal of the wash pipe, the valve closure element 70B moves automatically to the closed and sealed position as shown in FIG. 2B, thereby containing the completion fluid and preventing its release into the formation 48. With the flapper valve 10B thus protecting the formation 48, clean-up operations, for example, cleaning up the well bore, can be carried out and the completion fluid can be recovered with the wash pipe 46 disengaged. After the completion fluid has been recovered, the work string 24 may then be retrieved from the well and a production tubing string may be run into the well in its place. Such operations may take several days, during which time the formation 48 is protected by closure of the lower flapper valve 10B.

Upon completion of the clean-up operations and recovery of the completion fluid, a production string is inserted into the well and is sealed against the upper packer 14 to provide for production from the formation 36 to the surface. Before the onset of production operations, however, the lower flapper valve 10B must be fractured to open the flow passage in the screen support sub so that formation fluids can be lifted to the surface.

Each valve closure member 70A, 70B is constructed so that it can be ruptured or otherwise destroyed in response to a mechanical or hydraulic opening force. Each flapper valve closure member is preferably constructed of a frangible material such as tempered glass which will rupture under an opening force to provide a fully opened bore through the production string. The frangible valve closure member is designed to rupture in response to the build-up of hydraulic pressure or in response to a downward penetrating impact force applied by a wire line tool or a drop bar. Preferably, each flapper valve closure member is constructed of tempered glass rather than ceramic or metal, which will reliably shatter into relatively small pieces which can be removed from the tubing by reverse flow of completion fluid. Additionally, each frangible valve closure member is supported by an elastomeric hinge 76A, 76B which is severed or otherwise cleanly separated from the valve closure element to provide clear passage through the valve in response to a rupturing force imparted by hydraulic or mechanical means directed onto the frangible sealing member.

Each valve body 66A, 66B is provided with a fluid passage bore 74A, 74B, respectively, and each valve housing 88A, 88B is provided with an enlarged bore 90A, 90B which defines a valve chamber 92A, 92B, respectively, to accommodate movement of the flapper valve closure member 70A, 70B from the valve open position as shown in FIG. 2A to the valve closed position as shown in FIG. 2B. The valve closure members 70A, 70B and hinges 76A, 76B are movably coupled to the valve bodies 66A, 66B which are mounted onto the connector subs 68A, 68B, respectively.

Figure 8:
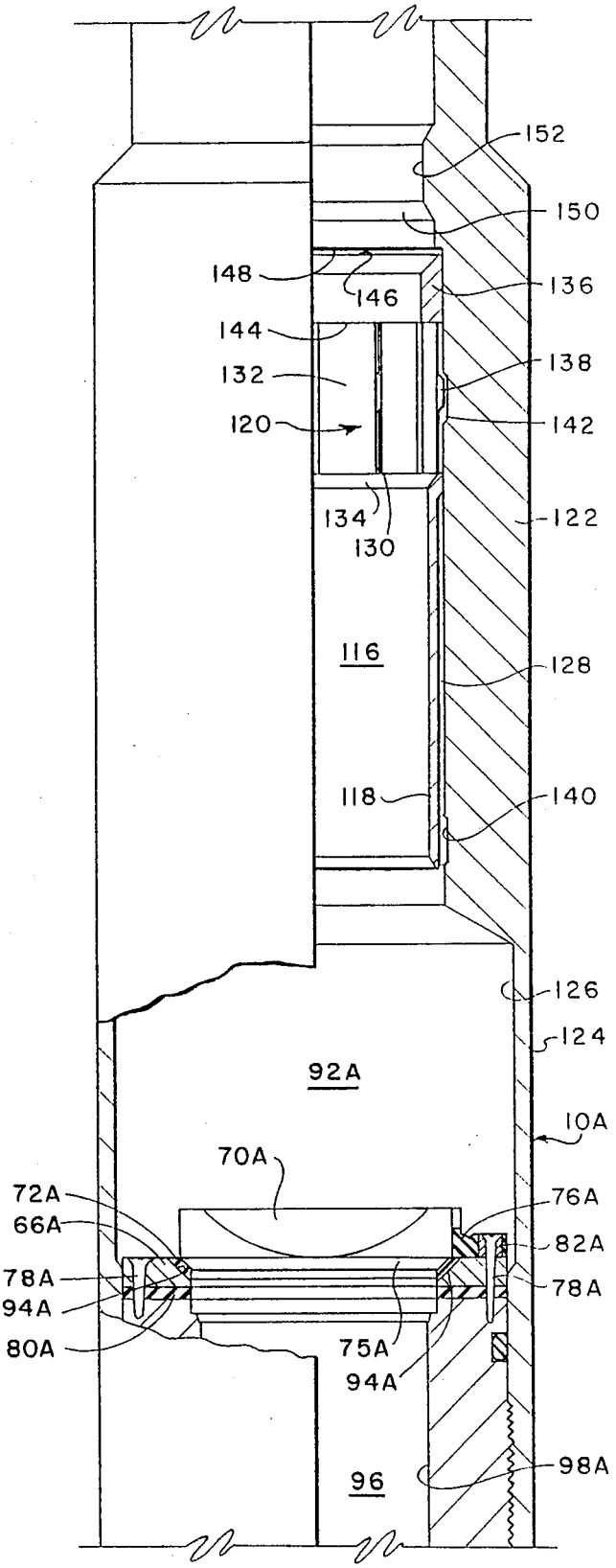
FIG. 8 is an enlarged elevational view, partially broken away, of the upper flapper valve and retracted prop sleeve shown in FIG. 7.

Referring now to FIGS. 4 and 8, the lower flapper valve assembly 10B is provided with a fluid passage bore 74B and a beveled counterbore 94B which defines a valve pocket. The side wall of the bore transitions along an annular sloping face which supports the resilient, annular seal 72B, preferably constructed of an elastomeric material. The valve closure member 70B has an annular, beveled side wall 75B which is dimensioned for surface-to-surface engagement with the beveled face of the annular seal 72B. Construction of the upper flapper valve assembly 10A is substantially identical to assembly 10B.

Each valve closure member 70A, 70B is preferably a frangible disk or plate of tempered glass, for example, a borosilicate glass having strength sufficient to withstand the expected operating pressures, and which will shatter into small pieces when impacted. Each elastomeric hinge 76A, 76B is joined directly to the cylindrical side wall of the glass disk in a process in which the molecular bond is produced at the interface between the elastomeric hinge and the glass during molding. Additionally, the bumper pad 84 of an elastomeric material is bonded to the underside of the glass closure disk 70B. The purpose of the bumper pad 84 is to engage and ride against the wash pipe 46 as shown in FIG. 4.

It will be appreciated that each glass closure member 70A, 70B when impacted by a drop bar will shatter thoroughly into relatively small pieces. Additionally, a fracturing impact force will tend to cause the glass disk to cleanly separate from its elastomeric hinge. It will be observed that the elastomeric hinge, because of its construction and mounting arrangement, does not project into the fluid flow passage. Moroever, any residual fragments of the glass disk which remain joined to the elastomeric hinge will be easily broken away and will not interfere with subsequent operation of a downhole operation.

Referring again to FIG. 2A and FIG. 2B, the upper and lower flapper valve assemblies 10A, 10B are joined together by a threaded union in tandem relation, thereby defining a controllable flow passage 96 which extends from the packer 14 to the screen 56. In the embodiment shown in FIG. 2A, the upper and lower flapper valve assemblies 10A, 10B, the packer 14, crossover tool 12, wash pipe 46, tail pipe 46T and screen 56 are run in assembled as shown in FIG. 1, with the tail pipe 46 extending in sealed engagement against the nipple 60 into the screen 56, with the lower flapper valve closure member 70B being propped open by engagement against the wash pipe 46, and the upper flapper valve closure member 70A being held open by a prop sleeve 100.

Referring now to FIG. 2A, the flapper valve closure disk 70A is held in valve open position by the prop sleeve 100. The prop sleeve 100 has a thin cylindrical side wall 102 which is concentrically received within the bore of the upper flapper valve housing sub 104A. In this embodiment (FIG. 2A), the prop sleeve 100 is secured by shear pins 106 which anchor the prop sleeve 100 onto a collar ring 108 which is fitted inside the threaded box of the valve housing sub 104A. The collar ring 108 is axially confined in a pocket formed within the threaded box by the threaded pin connector 64P of screen support sub 64. According to this arrangement, the flapper valve 10A is held open by the prop sleeve 100 during the initial run-in installation and initial service operations to permit unrestricted movement of the wash pipe 46 and other downhole tools through the flow passage 96.

The valve connector sub 68A is secured by threaded connection to the barrel 88A of upper valve housing sub 104A. Likewise, the lower valve connector sub 68B is secured by threaded pin and box connection to the barrel 88B of lower valve housing sub 104B. Each valve connector sub 68A, 68B has a bore 98A, 98B, respectively, which is concentric with the flow passage 96. According to this arrangement, the upper and lower flapper valve assemblies are selectively operable to close and open the flow passage 96 between the packer 14 and the screen 56 to protect the producing formation 48 from the effects of fluid pressure within the upper well bore annulus 42 while accommodating separate well service operations.

The upper flapper valve closure plate 70A is subsequently released by applying a shearing force against the lower annular face 110 of the prop sleeve 100. In the embodiment shown in FIG. 2A, the shearing force is applied against the lower annular face 110 of the prop sleeve 100 by a shearing tool (not illustrated) which is run into the well until it engages the lower annular face 110 of the prop sleeve 100. The force of retraction is reacted through the shear pins 106 and the collar ring 108 until the shear rating of the pins 106 is overcome. Upon retraction and clearance of the prop sleeve 100, the upper flapper valve closure plate 70A rotates into seated engagement against the valve seat 72A, thereby closing flow passage 96 and isolating the screen 56 with respect to the packer bore 30. Thus the completion fluid remaining in the upper annulus 42 is conserved and can be recovered by pumping it to the surface.

By the foregoing arrangement, only a limited amount of heavy completion fluid is permitted to escape into the formation during an intervening well service operation such as an electrical log which is performed after rupturing of the lower flapper valve closure plate 70B, and prior to closure of the upper flapper valve closure plate 70A. After the remaining completion fluid has been pumped to the surface, the upper closure plate 70A is fractured mechanically or hydraulically as previously discussed, thereby opening the flow passage 96 between the packer and the screen so that production operations can be initiated.

Figure 5:
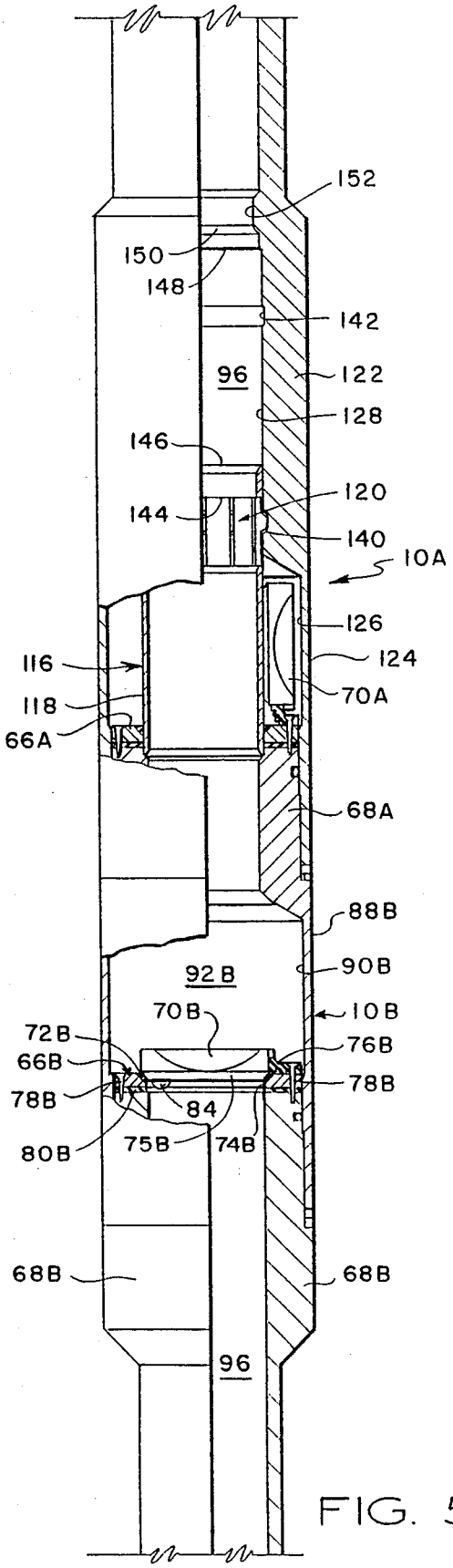
FIG. 5 is an elevation view, partly in section, of the upper flapper valve assembly held open by a movable prop sleeve and collet latch combination.
Figure 6:
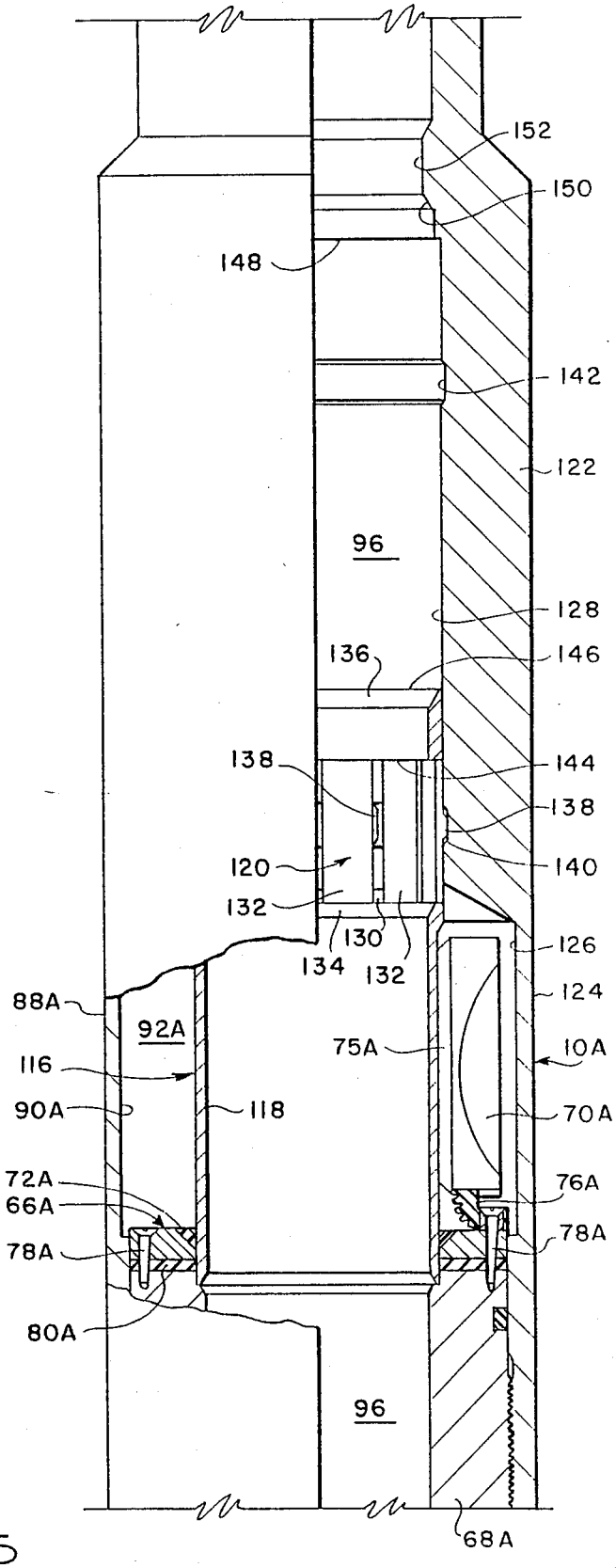
FIG. 6 is a longitudinal sectional view of the upper flapper valve assembly shown in FIG. 5.
Figure 7:
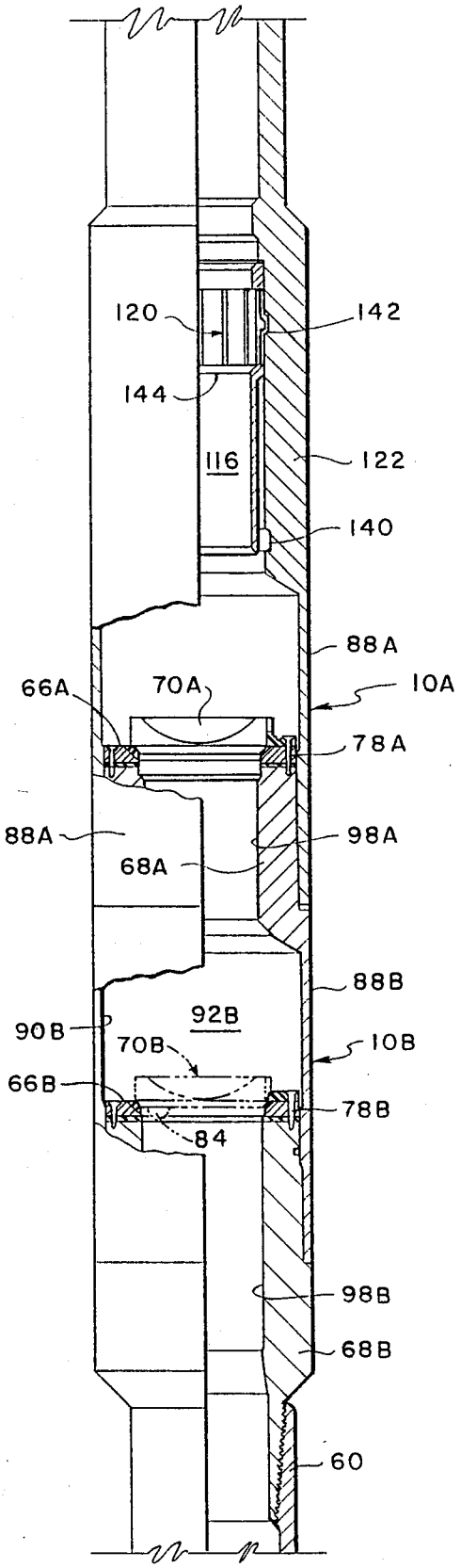
FIG. 7 is a sectional view, partially broken away, and similar to FIG. 5, which illustrates the valve closed position of the upper flapper valve and the retracted position of the prop sleeve, with the lower flapper valve closure member ruptured.

Referring now to FIGS. 5, 6, 7 and 8, an alternative prop sleeve assembly 116 is illustrated. In this embodiment, the prop sleeve assembly 116 includes a prop sleeve 118 and a collet latch 120. The prop sleeve 118 is connected in tandem with the collet latch 120, with the prop sleeve/collet latch assembly 116 being movable between an extended, blocking position as shown in FIGS. 5 and 6 in which the upper flapper valve closure plate 70A is engaged and propped open by the prop sleeve 118, to the retracted, unblocked position as shown in FIGS. 7 and 8 in which the upper flapper valve closure member 70A is released and seated in valve closed engagement against the valve body 66A, thereby closing flow passage 96. In this embodiment, the collet latch assembly 116 is initially set in the extended, valve open position and is subsequenty retracted to the unblocked position by a wire line shifting tool (not illustrated). A suitable wire line shifting tool is disclosed in U.S. Pat. No. 3,051,243, which is assigned to the assignee of the present application, and is hereby incorporated by reference.

The collet latch 120 is received within a screen support sub 122. The screen support sub 122 has a cylindrical barrel 124 having an enlarged bore 126 which encloses the upper valve chamber 92A. The screen support sub 122 also has a reduced diameter bore 128 in which the collet 120 is slidably received. The collet sleeve 120 has longitudinal slots 130 which separate longitudinal fingers 132. The collet fingers 132 are stabilized at their upper and lower end portions by annular connector rings 134, 136, respectively. Each finger 132 is provided with a knuckle in the form of a external boss 138 which projects radially outwardly. The bosses 138 are receivable in detented engagement within annular locating recesses 140, 142 which are formed at axially spaced locations on the bore of the screen support sub 122. The recesses 140, 142 serve as detents which when engaged by the external bosses 138 hold the collet latch 120 in the extended, valve open position as shown in FIG. 6, or in the retracted, valve closed position as shown in FIGS. 7 and 8.

The collet latch 120 has an internal shoulder 144 which is engagable by a wire line shifting tool. As described in U.S. Pat. No. 3,051,243, the shifting tool is run through the well bore until it engages the device to be shifted. In the arrangement shown in FIGS. 5, 6, 7 and 8, the shifting tool is run into latching engagement with the shifting shoulder 144 of the collet latch 120. As the wire line shifting tool is pulled toward the surface, the collet 120 and prop sleeve 118 are retracted through the bore 128 of connector sub 122. The fingers 132 deflect radially inwardly, thereby permitting cam surfaces on the bosses 138 to ride out of the detent recess 140, and slide against the bore 128 of screen support 122 until the bosses 138 snap into detented engagement in the upper detent recess 142.

Further travel of the collet latch 120 is prevented by engagement of the upper annular face 146 of connector ring 136 against a radially stepped shoulder 148 which is formed on the screen support sub 122. At the same time, a release arm carried on the shifting tool engages a beveled shoulder 150 just above the stepped shoulder 148, thereby tripping the shifting tool and permitting it to negotiate a reduced diameter bore 152 formed in the screen support sub 122 so that it can be retrieved to the surface.

The collet latch 120 and prop sleeve 118 are retained in the blocking, closed valve position as shown in FIG. 8 as a result of the detented engagement between the bosses 138 and the annular recess 142. After the shifting tool has cleared the bore, the upper valve closure plate 70A is fractured by the application of mechanical impact or hydraulic pressure as previously discussed. The collet latch 120 and pro sleeve 116 are maintained in the non-interfering, open bore position as shown in FIG. 8 to permit production operations to be carried out.

According to the foregoing arrangement, the producing formation 48 is protected during a service operation such as a gravel pack in which the lower and upper flapper valves are utilized for controlling flow to the well screen 56, with both flapper valves being held open during the service operation, and the lower flapper valve being closed upon withdrawal of the wash pipe from the screen and during clean-up operations. The lower flapper valve assembly 10B is forcibly opened by the application of hydraulic or mechanical means while the upper flapper valve 10A remains propped open to accommodate an intervening well service operation such as an electrical log, which is carried out after completion fluid has been introduced into the well bore and prior to initiation of production operations. According to the first embodiment, the upper flapper valve is propped open by the prop sleeve 100 which is maintained in its extended, valve open position by shear pins. The upper flapper valve is selectively closed upon completion of the intervening service operation to isolate completion fluids in the well bore from the screen and production formation during subsequent retrieval of the work string and installation of the production string.

Figure 9:
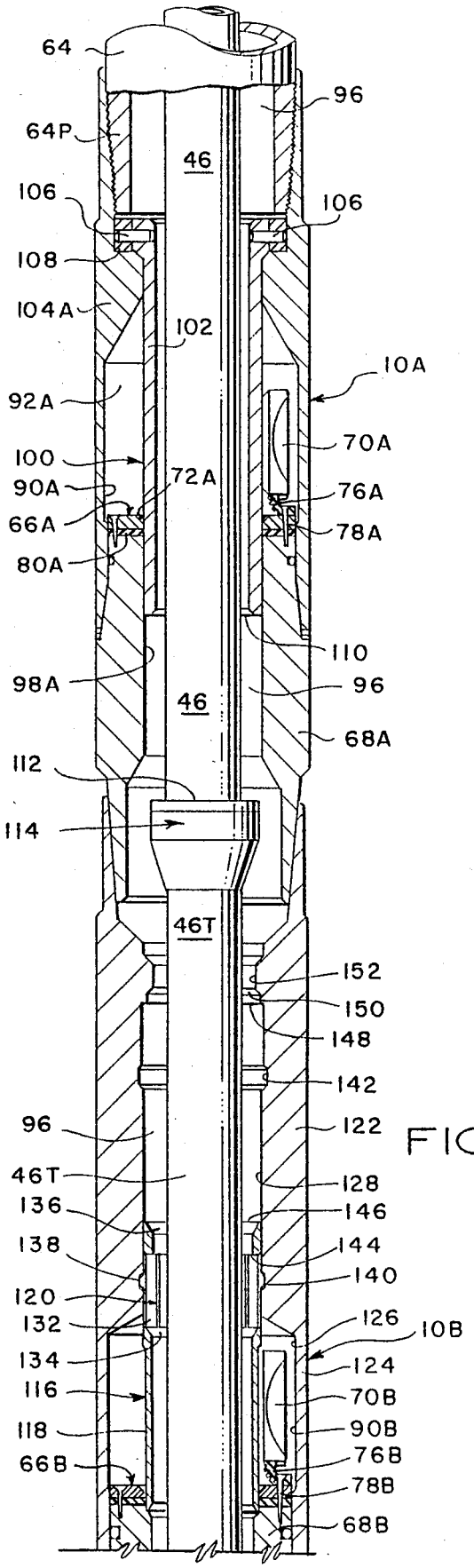
FIG. 9 is a longitudinal sectional view of an alternative dual flapper valve embodiment showing the run-in position of the flapper valves.
Figure 10:
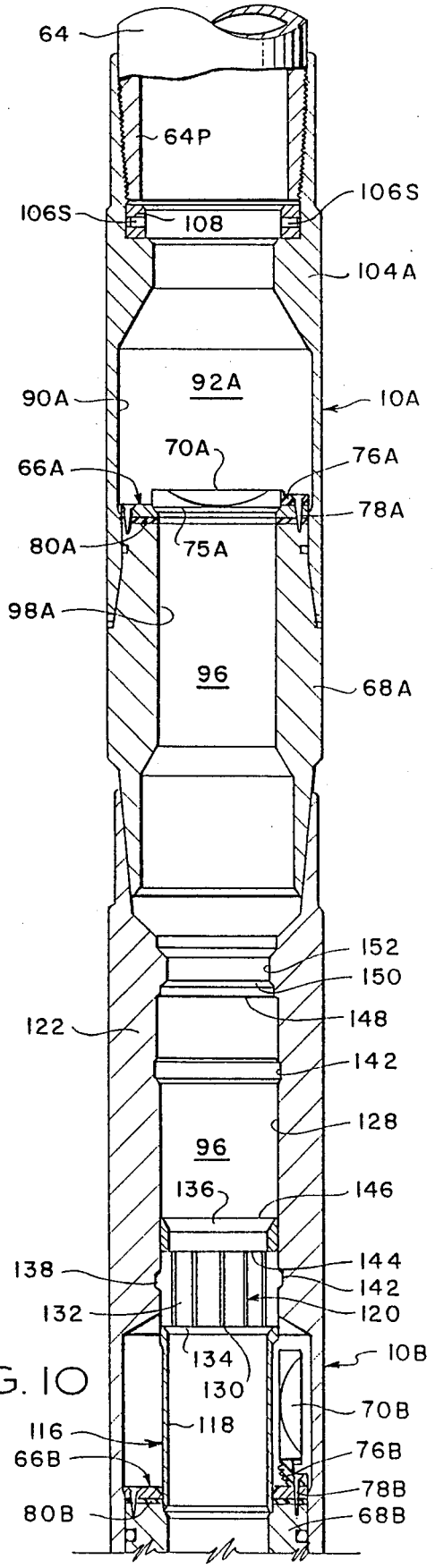
FIG. 10 is a view similar to FIG. 9 showing closure of the upper flapper, valve after retraction of the wash pipe; and, FIG. 11 is a view similar to FIG. 10 illustrating closure of the lower flapper valve upon conclusion of an electrical log operation.
Figure 11:
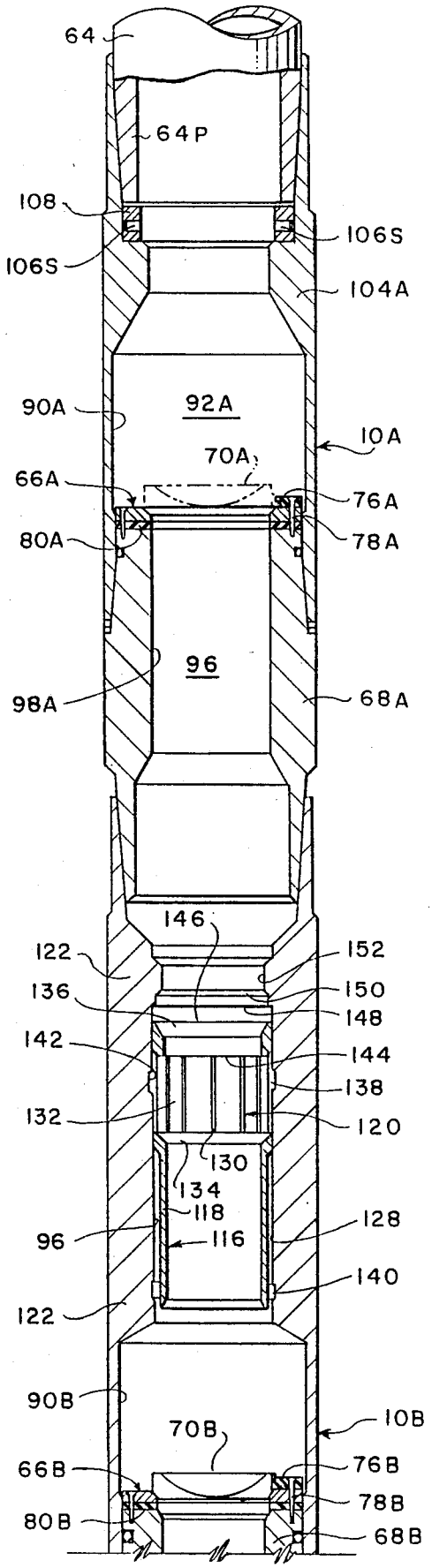

Referring now to FIGS. 9, 10 and 11, yet another alternative embodiment is illustrated. In this embodiment, the closure plate 70A of upper flapper valve assembly 10A is propped open by the tubular prop sleeve 100, with the tubular sleeve 100 being secured by shear pins 106 to the collar 108. In this alternative arrangement, however, the closure plate 70B of the lower flapper valve assembly 10B is propped open by the prop sleeve assembly 116 which includes a prop sleeve 118 and a collet latch 120. The prop sleeve 118 is connected in tandem with the collet latch 120, with the prop sleeve/collet latch assembly 116 being movable between an extended, blocking position as shown in FIGS. 9 and 10 in which the lower valve closure plate 70B is engaged and propped open by the prop sleeve 118, to the retracted, unblocked position as shown in FIG. 11, in which the lower flapper valve closure member 70B is released and seated in valve closed engagement against the valve body 66B, thereby closing the flow passage 96. In this alternative embodiment, the collet latch assembly 116 is initially set in the extended, valve open position and is subsequently retracted to the unblocked position by a wire line shifting tool (not illustrated). A suitable wire line shifting tool is disclosed in U.S. Pat. No. 3,051,243, incorporated herein by reference.

Operation of the upper flapper valve assembly 10A and lower flapper valve assembly 10B is the same as previously described with respect to the embodiment shown in FIG. 2A and FIG. 5, with the exception that the lower flapper valve assembly 10B as shown in FIG. 9 is propped open by the prop sleeve assembly 116 instead of being propped open by the tail pipe 46T.

An important difference in the arrangement shown in FIGS. 9, 10 and 11 is that the upper flapper valve assembly is released first, and the closure plate of the lower flapper valve assembly being released subsequently after completion of an intervening well service operation. According to an important feature of this embodiment, the tail pipe portion 46T is joined to the wash pipe 46 by an enlarged box connector 114 having a shoulder 112. In this arrangement, as the wash pipe and tail pipe 46T are retracted upwardly, the enlarged annular shoulder 112 engages the lower annular face 110 of the prop sleeve 100. The force of retraction is reacted through the shear pins 106 and the collar ring 108 until the shear rating of the pins 106 is overcome. The prop sleeve is retrieved to the surface along with the work string and the wash pipe 46. Upon clearance of the tail pipe 46T, the upper flapper valve closure plate 70A rotates into seated engagement against valve seat 72A, thereby closing flow passage 96 and isolating the screen with respect to the packer bore 30 as illustrated in FIG. 10. Completion fluid remaining in the upper annulus 42 is thereby conserved and can be recovered by pumping it to the surface.

Referring again to FIG. 10, when it is desirable to perform an intervening well service operation such as an electric log, the upper flapper valve closure plate 70A is fractured hydraulically or mechanically with a drop bar, which opens the flow passage 96 to permit an electrical logging tool to be inserted into the bore of the screen 56. The lower valve closure plate 70B is propped open by the prop sleeve assembly 116 during the electrical logging operation. After the logging operation has been concluded, the electrical logging tool is retrieved from the well, and the lower flapper valve closure plate 70B is closed by retracting the prop sleeve assembly 116. This is carried out as previously described with the aid of a wire line shifting tool which is run into latching engagement with the shifting shoulder 144 of the collet latch 120.

An advantage of the foregoing arrangement is that the upper flapper valve 10A is automatically closed upon retrieval of the wash pipe, thereby avoiding loss of completion fluid during the time which would otherwise be required to run in a shearing tool to engage and forcibly release the prop sleeve 102 from the collar 108. The embodiment shown in FIGS. 9, 10 and 11 also can be used to good advantage with undersized wash pipe. In some instances, it might be desirable to use an undersized wash pipe, and if undersized wash pipe were used to prop open the lower closure plate 70B as shown in FIG. 5, the flapper might ride at a large angle with respect to the axis of the bore. Under such conditions, it is possible that frictional engagement between the bumper pad 84 and the surface of the wash pipe could be great enough to cause binding or seizure, thereby breaking the frangible closure plate prematurely. This situation is avoided by using the movable collet latch 120 and prop sleeve assembly 116 as illustrated in FIGS. 9, 10 and 11.

Although the invention has been described with reference to specific embodiments, and with reference to a specific gravel pack and electrical logging operation, the foregoing description is not intended to be construed in a limiting sense. Various modifications of the disclosed embodiments as well as alternative applications of the invention will be suggested to persons skilled in the art by the foregoing specification and illustrations. It is therefore contemplated that the appended claims will cover any such modifications, applications or embodiments as fall within the true scope of the invention.

What is claimed is:

1. A dual flapper valve assembly for limiting the loss of completion fluid in connection with a well service operation comprising, in combination:

tubular support means defining a flow passage;

a first flapper valve assembly connected in series flow relation with said support means, said first flapper valve assembly having a valve closure member movable between first and second positions for closing and opening said flow passage;

a second flapper valve assembly connected in series flow relation in said support means, said second flapper valve assembly having a valve closure member movable between open and closed passage positions for closing and opening said flow passage;

a prop sleeve mounted within said support means, said prop sleeve being movable from an extended position in which it props the closure member of one flapper valve in the open passage position to a retracted position in which said closure member is disengaged and released for movement to the closed passage position, the valve closure member of one of said flapper valve assemblies being engageable by a wash pipe extending through said flow passage to prop the valve closure member in the open passage position, and being movable to the closed passage position upon retraction of said wash pipe out of said flow passage;

wherein said wash pipe including a tail pipe and a coupling collar connecting said tail pipe to said wash pipe, said coupling collar having an annular face which is engageable with said prop sleeve for applying a shearing force thereto upon retraction of said wash pipe.

2. A dual flapper valve assembly as defined in claim 1, said prop sleeve being attached to said tubular support means by shearable means.

3. A dual flapper valve assembly as defined in claim 2, said shearable means comprising a shear pin.

4. A dual flapper valve assembly as defined in claim 1, including a collet latch mounted for slidable movement within said support means, said prop sleeve and collet latch being connected in tandem relation, said collet latch being movable between an extended, blocking position in which the valve closure plate of one flapper valve is engaged and propped open by said prop sleeve, to a retracted, unblocked position in which said flapper valve closure member is released for movement to its closed passage position.

5. A dual flapper valve assembly as defined in claim 4, wherein said collet latch having flexible fingers which are separated circumferentially by longitudinal slots, each collet finger having an external boss projecting radially;

said tubular support means having a tubular sidewall and first and second annular locating recesses formed in said sidewall at axially spaced locations; and, said external bosses being received in detented engagement in said first annular locating recess when said collet latch is in the extended, blocking position, and said bosses being received in detented engagement within said second annular locating recess when said collect latch is in the retracted, unblocked position.

6. A dual flapper valve assembly as defined in claim 1, including:

a second prop sleeve mounted within said tubular support means, said second prop sleeve being movable from an extended position in which it props the closure member of said other flapper valve in the open passage position to a retracted position in which said closure member is disengaged and released for movement to its closed passage position; and, shearable means connecting one of said prop sleeve to said tubular support means, and including a collet latch mounted for slideable movement within the bore of said support means, said other prop sleeve and said collet latch being connected in tandem relation, said collet latch being movable between an extended, locking position in which the valve closure plate of one flapper valve is engaged and propped open by said prop sleeve, to a retracted, unblocked position in which said flapper valve closure member is released for movement to its closed passage position.

7. A dual flapper valve assembly for limiting the loss of completion fluid in connection with a well service operation comprising, in combination:

tubular support means defining a flow passage;

a first flapper valve assembly connected in series flow relation with said tubular support means, said first flapper valve assembly having a valve closure member movable between first and second positions for closing and opening said flow passage;

a second flapper valve assembly connected in series flow relation in said tubular support means, said second flapper valve assembly having a valve closure member movable between first and second positions for closing and opening said flow passage;

a first prop sleeve mounted within said tubular support means, said first prop sleeve being movable from an extended position in which it props the closure member of the first flapper valve in the open passage position to a retracted position in which said first closure member is disengaged and released for movement to the closed passage position;

a second prop sleeve mounted within said tubular support means, said second prop sleeve being movable from an extended position in which it props the closure member of the second flapper valve in the open passage position to a retracted position in which said second closure member is disengaged and released for movement to the closed passage position; and, said first prop sleeve being attached to said tubular support means by shearable means, and said second prop sleeve being supported within said tubular support conduit by a collet latch mounted for slideable movement within said tubular support means, said second prop sleeve and collet latch being connected in tandem relation, said collet latch being movable between an extended, blocking position in which the valve closure plate of said second flapper valve is engaged and propped open by said second prop sleeve, to a retracted, unblocked position in which the valve closure member of the second flapper valve is released for movement to its closed passage position.

8. A gravel packing apparatus for treating a formation surrounding a perforated zone of a subterranean well casing comprising, in combination:

a packer including a mandrel having a bore, anchoring and sealing means for securing said mandrel on said well casing and sealing therebetween; a screen support sub attached to and depending from the packer mandrel; a screen coupled to said screen support sub in communication with said packer bore; a first flapper valve assembly coupled to said support sub and interposed between said screen and said packer bore, said first flapper valve assembly including a valve seat having a bore therethrough and a frangible valve closure plate rotatable about pivot means carried by said valve seat for preventing flow through said first valve bore when said closure plate is engaged against said first valve seat; a second flapper valve assembly coupled to said support sub and interposed between said screen and the bore of said first flapper valve assembly, said second flapper valve assembly including a valve seat having a bore therethrough and a frangible valve closure plate rotatable about pivot means carried by said second valve seat for preventing flow through said second valve bore when said second closure plate is engaged against said second valve seat; a tubular prop sleeve mounted within said support sub for axial movement from a first position in which said prop sleeve engages the valve closure plate of said first flapper valve assembly and holds said closure plate in the open passage position, to a second position in which said prop sleeve is disengaged from said first closure plate to permit said first closure plate to move into sealing engagement against said valve seat.

9. A method for limiting the loss of completion fluid during successive well service operations comprising the steps:

installing lower and upper flapper valves having frangible closure plates movable between open bore and closed bore positions in the flow passage of a tubular support sub between a packer and a screen;

holding the closure plate of the lower flapper valve in the open bore position by engaging the lower valve closure plate with a wash pipe suspended in said flow passage;

closing the closure plate of said lower flapper valve upon retraction of a wash pipe through said support sub;

holding the closure plate of the upper flapper valve in the open bore position by a prop sleeve mounted within said support sub;

rupturing the closure plate of said lower flapper valve;

running a well service tool through said prop sleeve and lower flapper valve;

conducting a well service operation;

retracting said well service tool through said prop sleeve and upper flapper valve; and, retracting said prop sleeve to permit the closure plate of said upper flapper valve to move to the closed bore position.

10. A method for protecting a producing formation during a well srvice operation in which a column of fluid is contained within the well annulus above a well screen comprising the steps of utilizing first and second flapper valves for controlling flow from the annulus to the well screen, with each flapper valve having a frangible valve closure element which is held open by first and second propping members and being separately rupturable by forcible means; closing the first flapper valve by actuating the first propping member for accommodating a first well service operation; forcibly opening the first flapper valve while the second flapper valve remains propped open by the second propping member to accommodate a subsequent well service operation, closing the second flapper valve by actuation of the second propping member upon completion of the subsequent service operation to isolate fluids in the well bore from the screen and the production formation during subsequent retrieval of the work string and subsequent running of the production string.

* * * * *